US011299366B2

(12) United States Patent
Smith

(10) Patent No.: US 11,299,366 B2
(45) Date of Patent: Apr. 12, 2022

(54) ROLL DISPENSER DRAWER INSERT APPARATUS

(71) Applicant: David Smith, Castle Pines, CO (US)

(72) Inventor: David Smith, Castle Pines, CO (US)

( * ) Notice: Subject to any disclaimer, the term of this patent is extended or adjusted under 35 U.S.C. 154(b) by 154 days.

(21) Appl. No.: 16/824,042

(22) Filed: Mar. 19, 2020

(65) Prior Publication Data

US 2021/0292124 A1 Sep. 23, 2021

(51) Int. Cl.
*B65H 35/00* (2006.01)
*A47B 77/04* (2006.01)

(52) U.S. Cl.
CPC ..... *B65H 35/008* (2013.01); *A47B 77/04* (2013.01); *B65H 35/002* (2013.01); *B65H 2301/51541* (2013.01)

(58) Field of Classification Search
CPC ..... B65H 35/008; B65H 2301/51541; B65H 35/002; A47B 77/04
USPC ..... 225/39, 1, 16, 38, 42, 106, 77, 37, 34; 83/175, 650, 649, 455, 610, 375, 378, 83/382
See application file for complete search history.

(56) References Cited

U.S. PATENT DOCUMENTS 1,917,376 A * 7/1933 Lee ..... B65D 83/0882 225/43
2,456,660 A * 12/1948 Werner ..... B65H 35/0006 225/35
2,463,037 A * 3/1949 Holm ..... A47F 3/02 312/34.23
2,936,936 A * 5/1960 Sano ..... B65H 35/002 225/43
2,951,623 A * 9/1960 Haley ..... B65H 35/002 225/54
3,050,224 A 8/1962 Drolshammer
3,214,227 A 10/1965 Filipowicz
3,739,964 A * 6/1973 Stine ..... B65D 85/672 225/47
3,915,364 A 10/1975 Dieguez
4,204,618 A * 5/1980 Reed ..... B65H 35/0006 225/106
5,190,199 A * 3/1993 Bulger ..... B65D 83/0882 225/1
5,222,644 A * 6/1993 Moreno ..... B65H 35/002 225/19
5,318,210 A * 6/1994 Morand ..... A47K 10/38 225/43
7,080,765 B2 7/2006 Miller
7,481,345 B2 1/2009 Rice
8,113,400 B1 * 2/2012 Santolalla ..... B65H 35/0006 225/34

(Continued)

*Primary Examiner* — Ghassem Alie

(57) ABSTRACT

A roll dispenser drawer insert apparatus for convenient storage and dispensing of rolled goods includes a housing that fits within a kitchen drawer. A pair of dowel supports is coupled to a housing left side and a housing right side within a housing inside. A dowel rod is coupled to the pair of dowel supports and secures a rolled good such as, but not limited to, aluminum foil, stretch wrap, wax paper, paper towels, and the like. A lid is hingingly coupled to the housing top side adjacent a housing back side and moves between a closed position covering an open portion of the housing top side and an open position exposing the open portion of the housing top side. A cutter is coupled to a lid underside of the lid adjacent a lid front side of the lid.

8 Claims, 5 Drawing Sheets

(56) References Cited

U.S. PATENT DOCUMENTS

| | | | | |
|---|---|---|---|---|
| D694,561 | S | 12/2013 | Eckert | |
| 9,161,621 | B1 | 10/2015 | Huffin | |
| 9,635,986 | B2 * | 5/2017 | Phelps | B65H 75/185 |
| 2002/0017588 | A1 * | 2/2002 | Kitayama | B65H 75/22 242/608.6 |
| 2004/0004101 | A1 * | 1/2004 | Bell | B26D 1/345 225/43 |
| 2007/0051770 | A1 | 3/2007 | Berg | |
| 2008/0035696 | A1 * | 2/2008 | Nichols | B65H 35/002 225/19 |
| 2012/0132686 | A1 | 5/2012 | Elash | |

* cited by examiner

ROLL DISPENSER DRAWER INSERT APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to roll dispenser devices and more particularly pertains to a new roll dispenser device for convenient storage and dispensing of rolled goods.

(2) Description of Related Art Including Information Disclosed Under 37 CFR 1.97 and 1.98

The prior art relates to roll dispenser devices which offer a variety of storage and cutting solutions for items such as aluminum foil, stretch wrap, toilet tissue, and the like. Existing devices fail to offer a housing sized to fit within a kitchen drawer or cabinet, and also lack a hinged lid with a finger access hole to easily access and replace the item being dispensed.

BRIEF SUMMARY OF THE INVENTION

An embodiment of the disclosure meets the needs presented above by generally comprising a housing having a housing front side, a housing back side, a housing left side, a housing right side, a housing bottom side, and an open housing top side defining a housing inside. The housing top side has a perimeter portion and an open portion. The housing is rectangular prismatic and configured to fit within a kitchen drawer or to be hung on a cabinet or pantry door. A pair of dowel supports is coupled to the housing left side and the housing right side within the housing inside. A dowel rod is coupled to the pair of dowel supports and configured to secure a rolled good such as, but not limited to, aluminum foil, stretch wrap, wax paper, paper towels, and the like. A lid is hingingly coupled to the housing top side adjacent the housing back side and moves between a closed position covering the open portion of the housing top side and an open position exposing the open portion of the housing top side. A cutter is coupled to a lid underside of the lid adjacent a lid front side of the lid.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
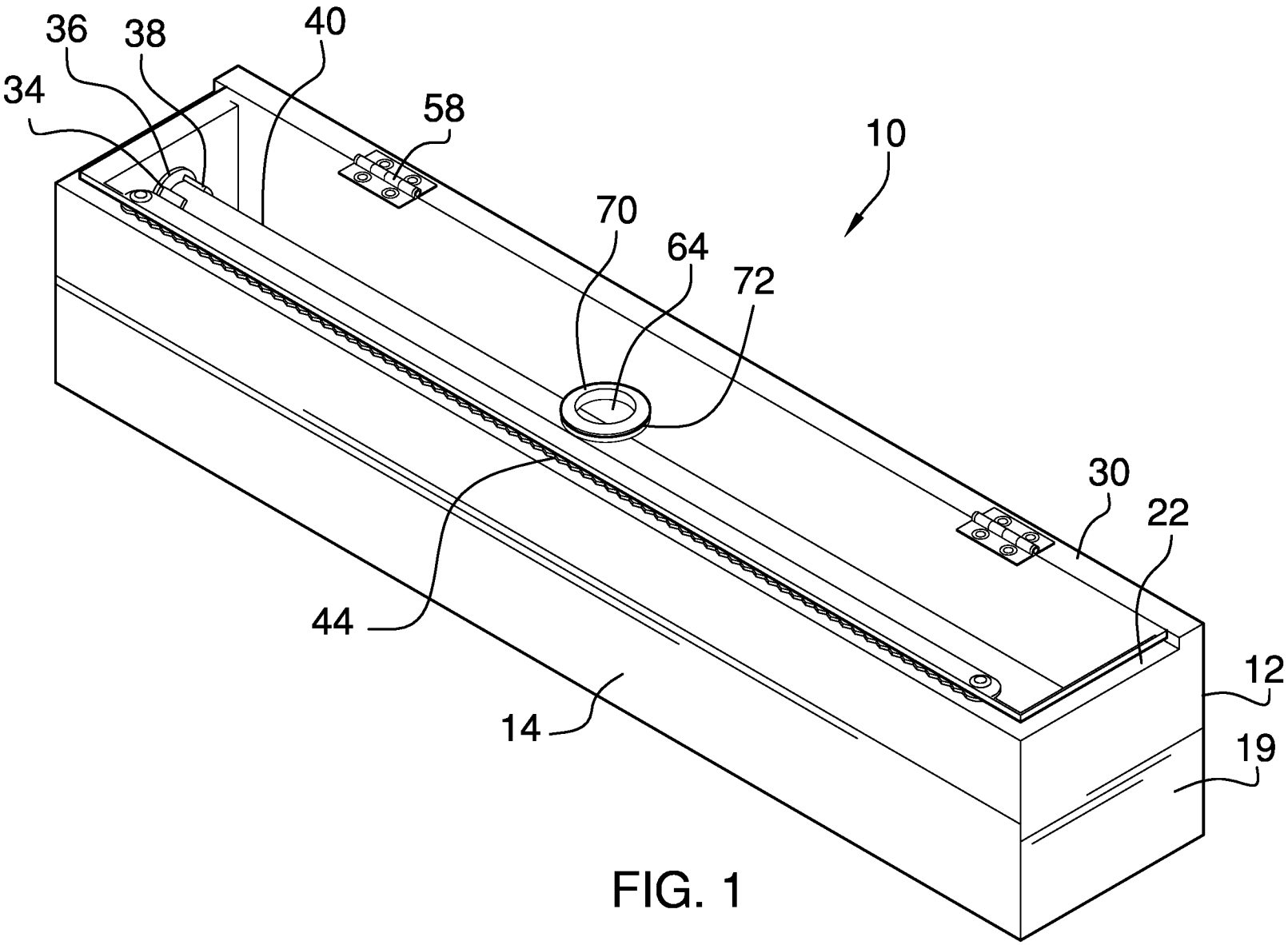
FIG. 1 is an isometric view of a roll dispenser drawer insert apparatus according to an embodiment of the disclosure.
Figure 2:
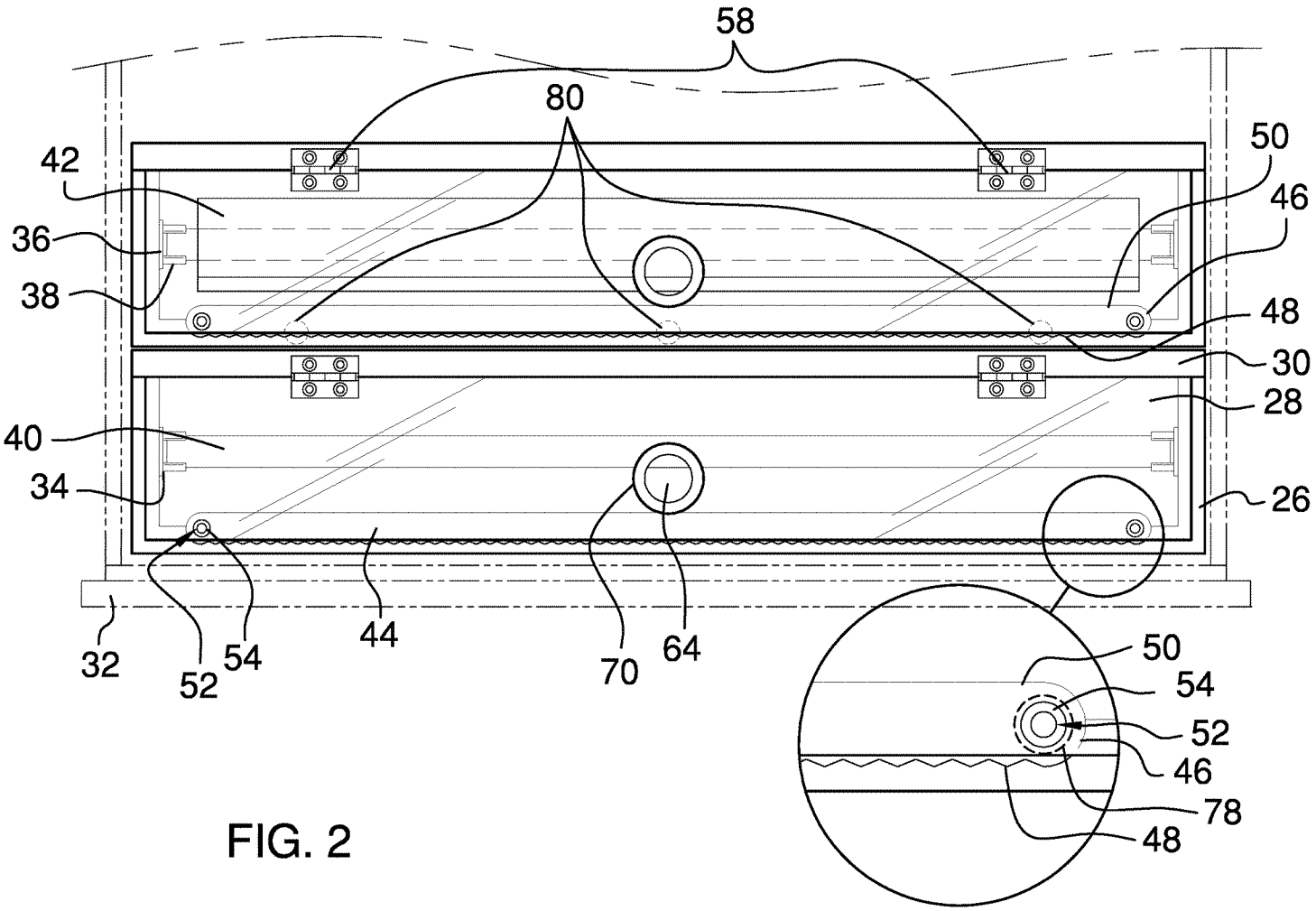
FIG. 2 is a top plan view of an embodiment of the disclosure.
Figure 3:
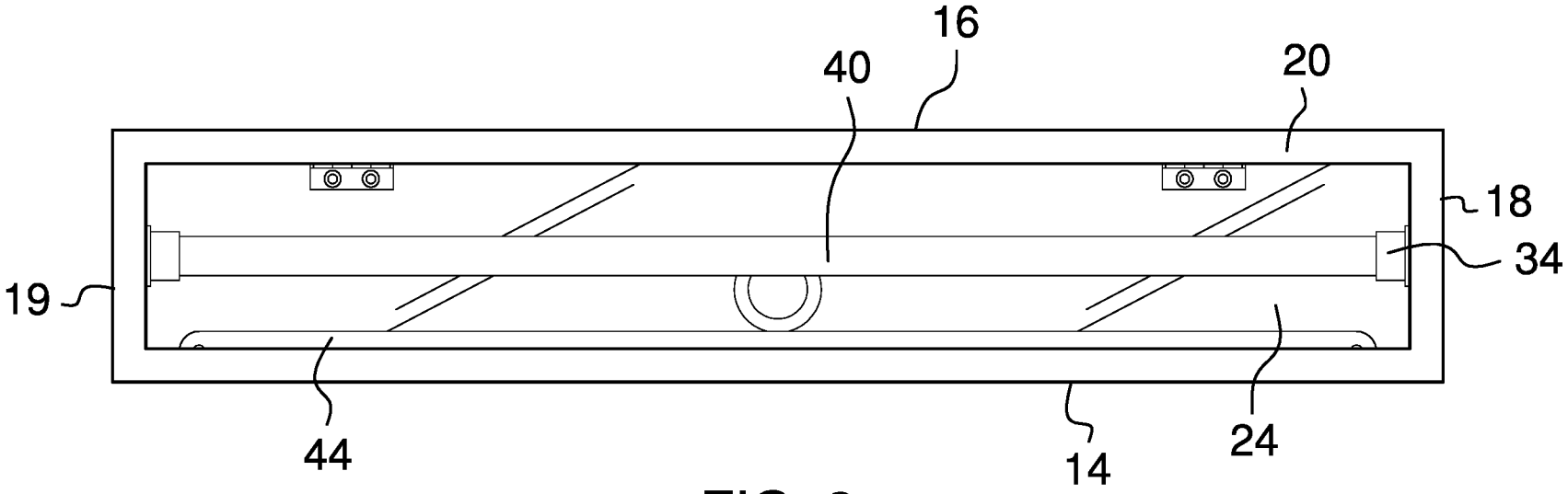
FIG. 3 is a bottom plan view of an embodiment of the disclosure.
Figure 5:
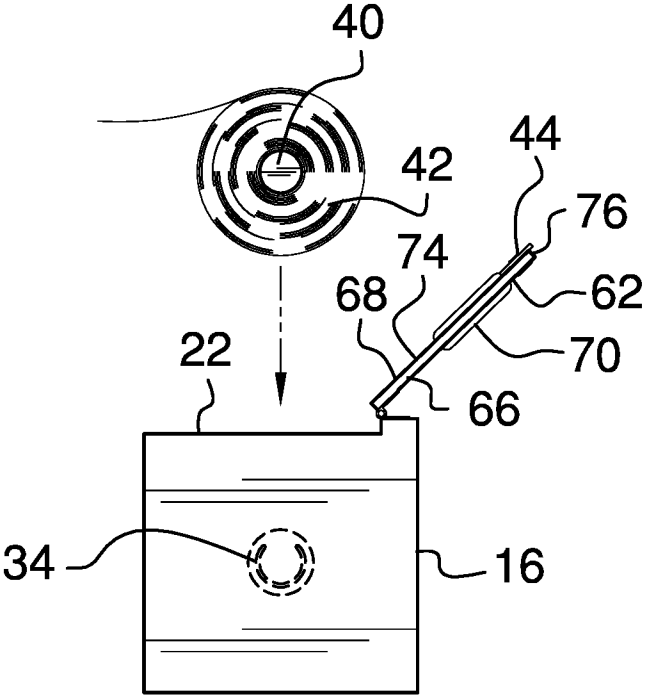
FIG. 5 is a side elevation view of an embodiment of the disclosure.
Figure 4:
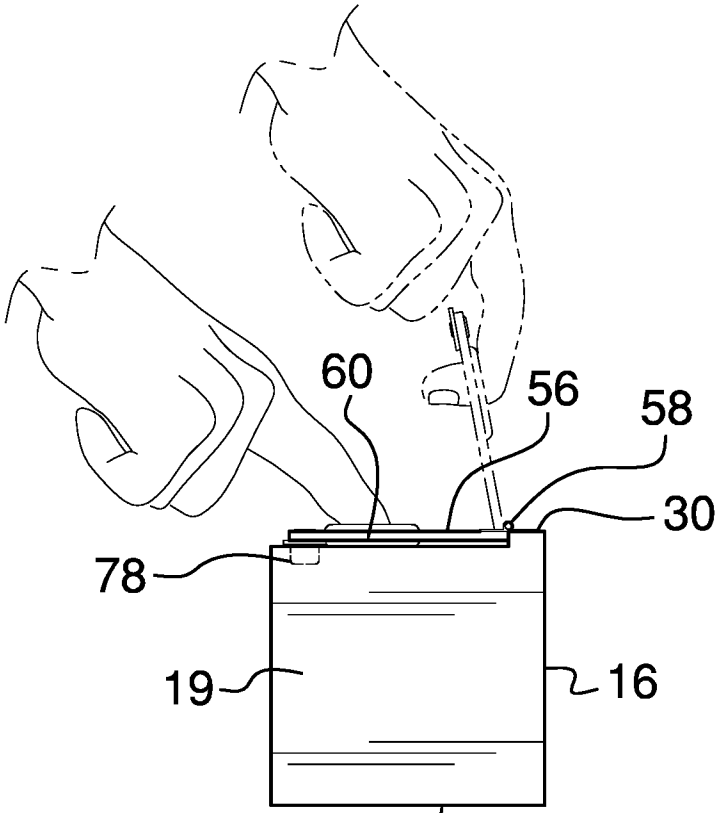
FIG. 4 is a side elevation view of an embodiment of the disclosure.
Figure 6:
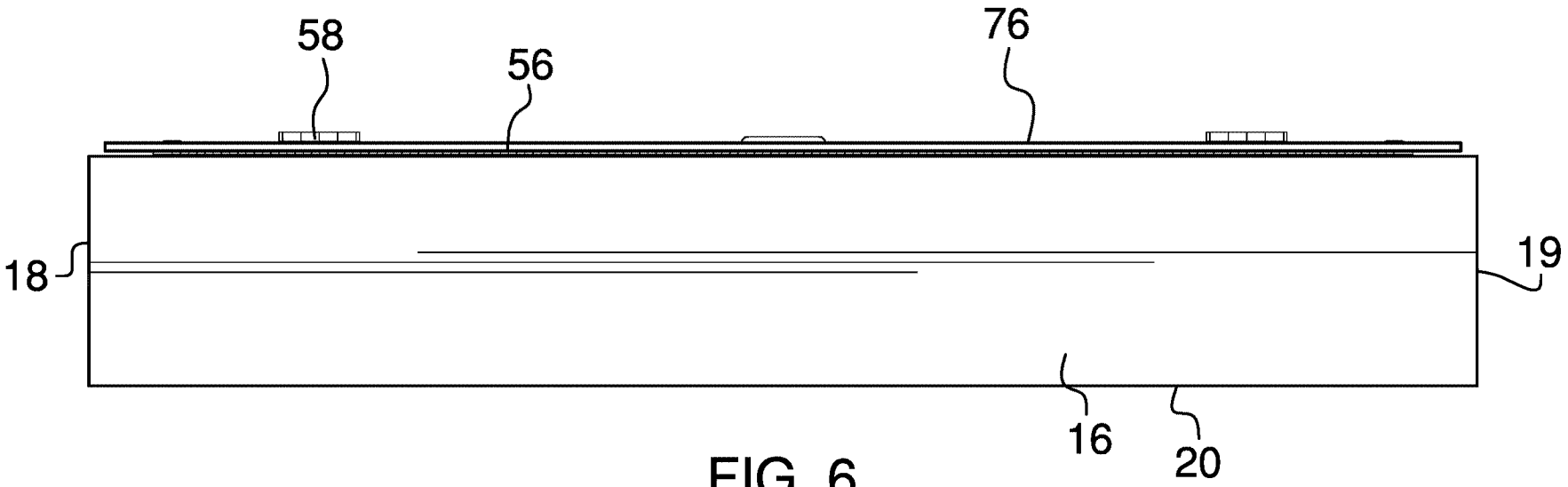
FIG. 6 is a front elevation view of an embodiment of the disclosure.

With reference now to the drawings, and in particular to FIGS. 1 through 6 thereof, a new roll dispenser device embodying the principles and concepts of an embodiment of the disclosure and generally designated by the reference numeral 10 will be described.

As best illustrated in FIGS. 1 through 6, the roll dispenser drawer insert apparatus 10 generally comprises a housing 12 having a housing front side 14, a housing back side 16, a housing left side 18, a housing right side 19, a housing bottom side 20, and an open housing top side 22 defining a housing inside 24. The housing top side 22 has a perimeter portion 26 and an open portion 28. The perimeter portion 26 may have an elevated section 30 adjacent the housing back side 16. The housing 12 is rectangular prismatic and configured to fit within a kitchen drawer 32 or hung on a cabinet or pantry door.

A pair of dowel supports 34 is coupled to the housing 12, The pair of dowel supports 34 is coupled to the housing left side 18 and the housing right side 19 within the housing inside 24. Each dowel support 34 may include a circular mount portion 36 coupled to the housing 12 and a partially cylindrical portion 38 extending from the circular mount portion 36. A dowel rod 40 is coupled to the pair of dowel supports 34. The partially cylindrical portion 38 of each dowel support selectively receives the dowel rod 40 and may be elastically expandable to allow the dowel rod 40 to snap fit and release. The dowel rod 40 is configured to secure a rolled good 42 such as, but not limited to, aluminum foil, stretch wrap, wax paper, paper towels, and the like.

A lid 56 is coupled to the housing 12. The lid 56 may have a pair of hinges 58 coupled to the elevated section 30 of the housing top side adjacent the housing back side 16. The lid 56 hingingly moves between a closed position 60 covering the open portion 28 of the housing top side and an open position 62 exposing the open portion 28 of the housing top side. The lid 56 in the closed position 60 lies coplanar with the elevated section 30. The lid 56 may have an access aperture 64 extending from a lid top side 66 through a lid bottom side 68. The access aperture 64 may have a rubberized grommet 70 extending around a perimeter 72 thereof for user comfort. The lid 56 may be transparent to allow the user to see how much of the rolled good 42 remains.

A cutter 44 is coupled to the lid 56. The cutter 44 is coupled to a lid underside 74 of the lid adjacent a lid front side 76 of the lid. The cutter 44 may have a pair of rounded distal ends 46, a serrated cutting edge 48, and an inner edge 50. The cutter 44 has a pair of attachment apertures 52 extending therethrough proximal the pair of distal ends 46 to receive attachment hardware 54 and selectively engage the lid underside 74 adjacent the lid front side 76. The cutter 44 may thus be removed and sharpened or replaced. The housing top side 22 may have a pair of depressions 78 to selectively receive the attachment hardware 54 when the lid 56 is closed. The serrated cutting edge 48 may extend beyond the lid front side 76 and is used to separate a portion of the rolled good 42. The access aperture 64 is configured to receive a user's finger to either lift the lid 56 or to apply pressure to the rolled good 42 while it is being cut on the cutter 44.

A plurality of magnets 80 may be coupled to the housing 12. The plurality of magnets 80 is coupled within the perimeter portion 26 of the housing top side adjacent the housing front side 14 to selectively engage the cutter 44 and maintain the lid 56 in the closed position 60.

In use, the rolled good 42 is placed on the dowel rod 40. The dowel rod 40 is then engaged with the pair of dowel supports 34 and the lid 56 is lowered to the closed position 60. As needed, the lid 56 is lifted to the open position 62 and a portion of the rolled good 42 is removed. The lid 56 is lowered to the closed position 60 and the rolled good 42 is cut with the cutter 44.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A roll dispenser drawer insert apparatus comprising:

a housing having a housing front side, a housing back side, a housing left side, a housing right side, a housing bottom side, and an open housing top side defining a housing inside, the housing top side having a perimeter portion and an open portion, the housing being rectangular prismatic and being configured to lit within a kitchen drawer or to be hung on a cabinet or pantry door;

a pair of dowel supports coupled to the housing, the pair of dowel supports being coupled to the housing left side and the housing right side within the housing inside;

a dowel rod coupled to the pair of dowel supports, the dowel rod being configured to secure a rolled good;

a lid coupled to the housing, the lid being hingingly coupled to the housing top side adjacent the housing back side and moving between a closed position covering the open portion of the housing top side and an open position exposing the open portion of the housing top side;

a cutter coupled to the lid, the cutter being coupled to a lid underside of the lid adjacent a lid front side of the lid; and a plurality of magnets coupled to the housing, the plurality of magnets being coupled within the perimeter portion of the housing top side adjacent the housing front side to selectively engage the cutter and maintain the lid in the closed position.

2. The roll dispenser drawer insert apparatus of claim 1 further comprising the lid having an access aperture extending from a lid top side through a lid bottom side, the access aperture being configured to receive a user's finger.

3. The roll dispenser drawer insert apparatus of claim 2 further comprising the access aperture having a rubberized grommet extending around a perimeter thereof.

4. The roll dispenser drawer insert apparatus of claim 1 further comprising the perimeter portion of the housing top side having an elevated section adjacent the housing back side, the lid being coupled to the elevated section, the lid in the closed position lying coplanar with the elevated section.

5. The roll dispenser drawer insert apparatus of claim 1 further comprising the lid being transparent.

6. The roll dispenser drawer insert apparatus of claim 1 further comprising the lid having a pair of hinges, the pair of hinges being coupled to the housing top side.

7. The roll dispenser drawer insert apparatus of claim 1 further comprising each dowel support including a circular mount portion coupled to the housing and a partially cylindrical portion extending from the circular mount portion, the partially cylindrical portion selectively receiving the dowel rod.

8. A roll dispenser drawer insert apparatus comprising:

a housing having a housing front side, a housing back side, a housing left side, a housing right side, housing bottom side, and an open housing top side defining a housing inside, the housing top side having a perimeter portion and an open portion, the perimeter portion having an elevated section adjacent the housing back side, the housing being rectangular prismatic and being configured to fit within a kitchen drawer or to be hung on a cabinet or pantry door;

a pair of dowel supports coupled to the housing, the pair of dowel supports being coupled to the housing left side and the housing right side within the housing inside, each dowel support including a circular mount portion coupled to the housing and a partially cylindrical portion extending from the circular mount portion;

a dowel rod coupled to the pair of dowel supports, the partially cylindrical portion of each dowel support selectively receiving the dowel rod, the dowel rod being configured to secure a rolled good;

a cutter coupled to the housing;

a lid coupled to the housing, the lid having a pair of hinges coupled to the elevated section of the housing top side adjacent the housing back side and hingingly moving between a closed position covering the open portion of the housing top side and an open position exposing the open portion of the housing top side, the lid in the closed position lying coplanar with the elevated section, the lid having an access aperture extending from a lid top side through a lid bottom side, the access aperture being configured to receive a user's finger, the access aperture having a rubberized grommet extending around a perimeter thereof, the lid being transparent;

a cutter coupled to the lid, the cutter being coupled to a lid underside of the lid adjacent a lid front side of the lid, the cutter having a pair of rounded distal ends, a serrated cutting edge, and an inner edge, the cutter having a pair of attachment apertures extending therethrough proximal the pair of distal ends to receive attachment hardware and selectively engage the lid underside adjacent the lid front side; and a plurality of magnets coupled to the housing, the plurality of magnets being coupled within the perimeter portion of the housing top side adjacent the housing front side to selectively engage the cutter and maintain the lid in the closed position.

* * * * *